United States Patent [19]

Kivenson

[11] 4,411,248

[45] Oct. 25, 1983

[54] CATAPULT CONSTRUCTION

[76] Inventor: Gilbert Kivenson, 22030 Wyandotte St., Canoga Park, Calif. 91303

[21] Appl. No.: 325,224

[22] Filed: Nov. 27, 1981

[51] Int. Cl.[3] ..... F41B 7/00

[52] U.S. Cl. ..... 124/20 R; 124/80; 273/428

[58] Field of Search ..... 124/17, 20 R, 41 R, 124/21, 22

[56] References Cited

U.S. PATENT DOCUMENTS 1,577,250 3/1926 Corp ..... 124/17

2,644,271 7/1953 Shapiro ..... 124/17 X 4,050,438 9/1977 Pfotenhauer ..... 124/20 R

*Primary Examiner*—Richard C. Pinkham

*Assistant Examiner*—William R. Browne

[57] ABSTRACT

A construction for compact catapults is described. An elastic cord is mounted and placed in tension by threading it through a number of grooved reels. The reels are rotatably fastened to capstans and thereby to a handle-equipped base. When a U-shaped pellet is hooked over a portion of the elastic cord, drawn back and then released, high acceleration forces are transferred to the pellet which then issues from the catapult.

5 Claims, 8 Drawing Figures

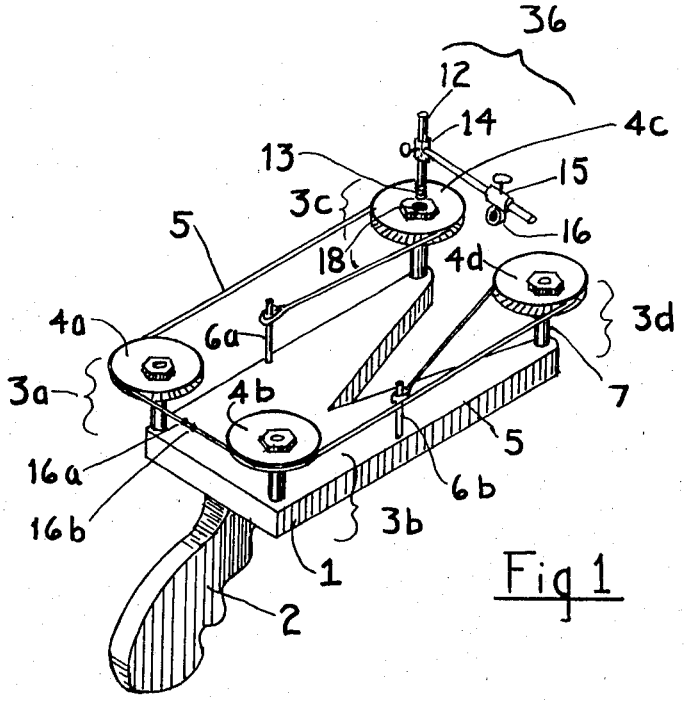
Fig 1
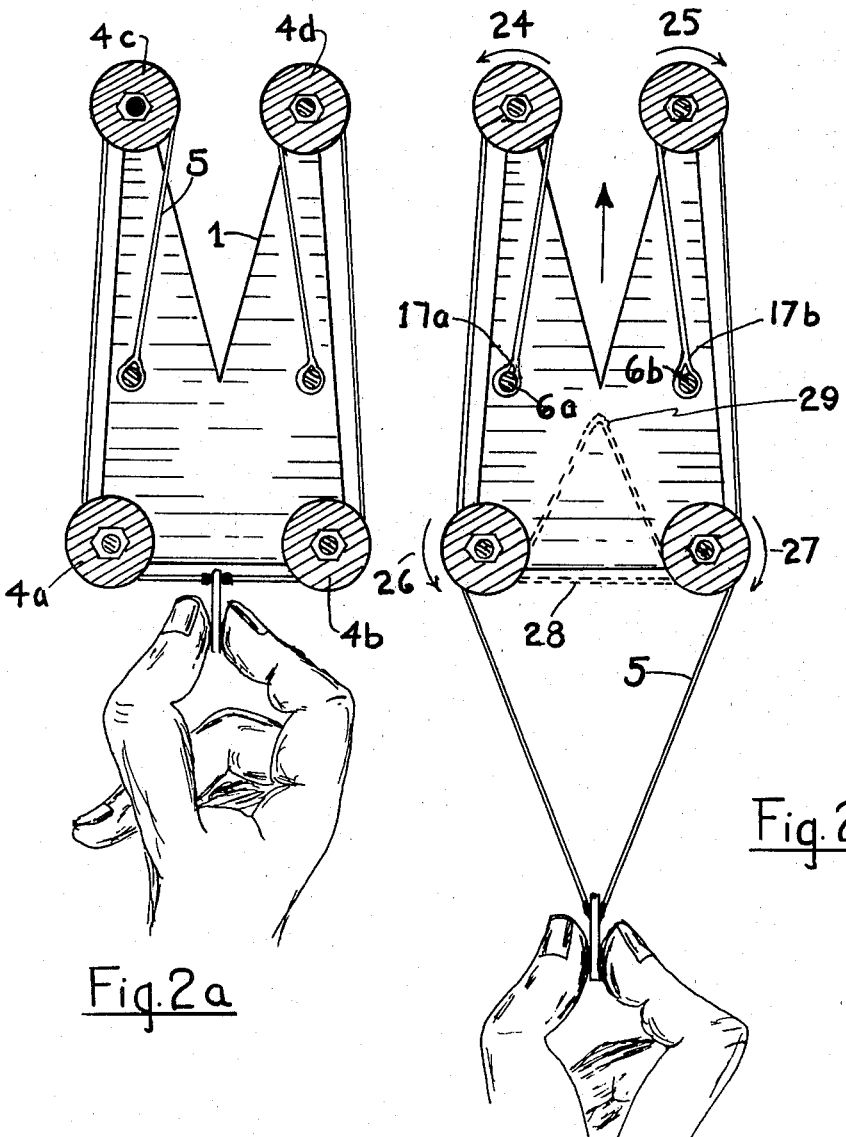
Fig. 2a
Fig. 2b

CATAPULT CONSTRUCTION

BACKGROUND OF THE INVENTION

This invention relates to mechanically actuated catapults for propelling projectiles. Mechanical devices for use in weaponry have continued to be of interest despite the great preponderance of guns and combustible powders. The archer's bow for example is widely used for target shooting and the taking of game. The projecting of missiles comparable in size and weight to a bullet has been accomplished over the centuries by the use of catapults and slings of various kinds. The most common of the present day devices employ two pieces of elastic tubing joined together by a shot holding pouch. The free ends of the tubing are attached to two legs of a Y-shaped structure. The third leg serves as a grip. This design of long standing makes inefficient use of the energy which is stored in the elastic. In the application of the weapon the elastic is stretched from a limp condition; a portion of the available reach of the user is thus wasted in taking up the slack in the elastic. When the pouch is released to discharge the sling, the elastic first contracts to the point of slackness. This amount of drive does not represent the optimum which could be obtained from the system. Further motion of the pouch and the release of the shot must come as a result of momentum.

In an archery bow, by contrast, the string is always taut. The full arm span of the archer is thus utilized. An additional advantage of the archer's bow over the sling is in the coupling between the driving element and the missile. In the sling the position of the pellet in the pouch is somewhat indeterminate. During release of the pouch the position of the latter which imparts force to the pellet varies from shot to shot. On a bow string, on the other hand, the point of drive is well defined. When the string reaches and passes its original position, it begins to decelerate and thus separates cleanly from the arrow. At this point the arrow has reached its maximum velocity.

The archer's bow does however have a major problem. The driving force comes from the relatively heavy flat springs which are its limbs. These possess considerable inertia and must therefore be made with considerable stiffness to achieve their purpose. To achieve arrow velocities of 200 or 300 feet per second, it is necessary to use bows having draws of 30 to 50 pounds.

Elastic materials for mechanical weaponry can be evaluated and compared by considering the force per unit density required to deflect a standard sized specimen of the material a unit distance. The lower the density, the less of the stored energy need be dissipated in accelerating the spring itself. When considered from this standpoint, rubber and elastomers in general are more efficient than fiberglass or metal springs.

From the standpoint of minimizing user effort it is desirable to employ long elastic elements so that the operating force can be applied gradually. It is difficult however to maintain compactness when long elastic members are used.

A few attempts have been made in the prior art to combine the archer's bow and the sling. Some bows for example have used double strings which incorporated a shot holding pouch. Catapults have also been devised for projecting arrows. U.S. Pat. No. 3,967,017 teaches a construction which is rifle-like in form, contains a stretched elastic band and launches an arrow. To date there has been no catapult which is compact and efficient.

The present invention overcomes many of the shortcomings of previous bows, catapults and combinations thereof. It is an objective of the present invention to provide, in a catapult, means for maintaining an elastic member in tension continuously so as to utilize to a greater extent the energy stored during drawback.

It is a second objective of the present invention to provide in a catapult means for folding a tensed elastic member several times so as to permit the use of relativel long elastic cords in a compact weapon.

The means for achieving these and other objectives will be described in the appended drawings, specifications and claims.

DESCRIPTION OF THE DRAWINGS

The features of the invention will be explained with reference to the following drawings.

FIG. 1 is a perspective view of the catapult.

FIG. 2*a* is a top view of the catapult showing the elastic drive at rest but with a pellet in place.

FIG. 2*b* is a top view of the catapult with the pellet drawn back.

DESCRIPTION OF THE INVENTION

Figure 3:
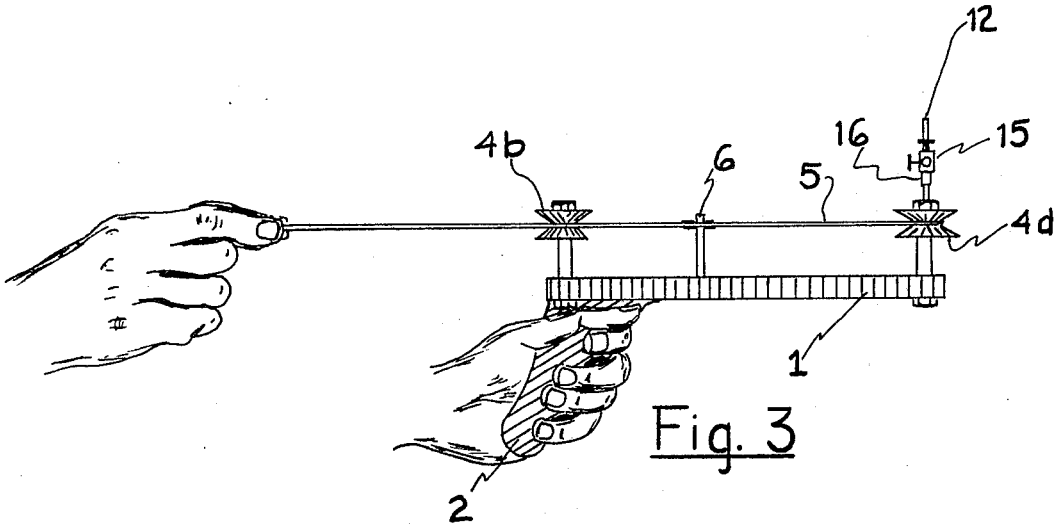
FIG. 3 is a side view of the catapult.

We refer now to FIG. 1. A base 1 is attached to a handle 2. The capstans 3*a*,3*b*,3*c* and 3*d* are rigidly mounted to the base 1. The capstans support the freely rotatanble reels 4*a*,4*b*,4*c* and 4*d* as shown. An elastic cord 5 is attached at one of its ends to the anchoring member 6*a*, passes around reel 4*c*, back around reel 4*a*, acorss to reel 4*b*, then around reel 4*d* and is finally anchored at its other end on the anchoring member 6*b*. The length of the elastic cord 5 is such that it is always in tension when mounted in the above described manner. The mounting pattern is also shown in FIGS. 2*a* and 2*b*.

The center of the elastic cord is marked at points 16*a* and 16*b* by imprinting on the cord or by the attachment of plastic markers.

If the eleastic cord is pulled back while the catapult is firmly held, reels 4*a* and 4*b* will rotate in the opposing directions 26 and 27 respectively as is shown in FIG. 2*b*. The reels 4*c* and 4*d* will rotate in the opposing directions 24 and 25 respectively. As a result of these rotations the stress in the elastic cord 5 will be distributed uniformly throughout its length. In addition to producing uniform tension this construction permits the use of a relatively long elastic cord while maintaining generally compact dimensions in the structure of the catapult. When the cord is released from its drawn back position, the reels return to their original positions also. The reels thus minimize rubbing friction so that little of the energy stored in the elastic cord is lost by rubbing.

After the released cord reaches its rest position as shown by the dotted line 28 in FIG. 2*b*, the center portion has achieved maximum velocity. The cord now continues to travel to the new position 29 but is now rapidly decelerating by virtue of the increasing force in the reverse direction.

In operation, a U-shaped pellet is slipped over the cord between the marked points 16*a* and 16*b* and is used to draw back the cord. When the pellet is released, it is accelerated by the now contracting cord and achieves a high velocity in the forward direction. The release point of the pellet from the cord is crisp and occurs at the position 28 of the cord.

Figure 4:
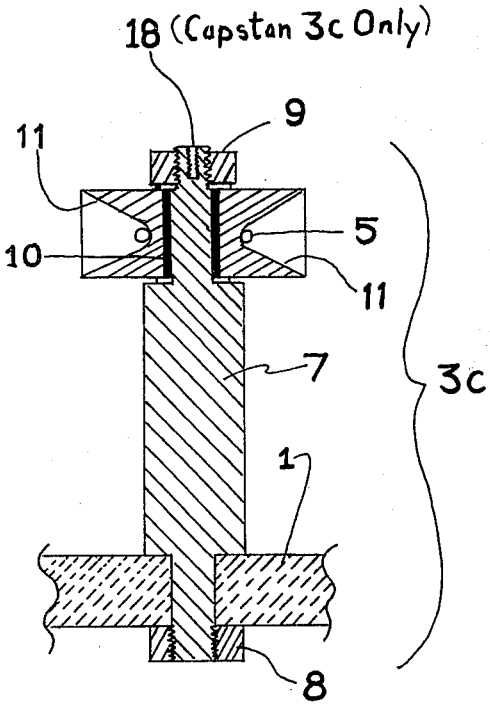
FIG. 4 is a cross sectional view of one of the capstans which are part of the catapult.

The construction of the capstans is shown in FIG. 4. Each capstan incorporates a center pillar 7 threaded at both ends. The pillar is held to base 1 by the nut 8. The reel is rotatably held to the pillar by the nut 9. The reels are provided with low friction bearing liners 10. The reels are made with the steeply slopiing sides 11. This construction provides a guide for the user as he draws back the elastic cord. He can sense when his drawback is not in a plane parallel to the base 1. Release of the projectile from any other plane will impair shooting accuracy.

Figure 5:
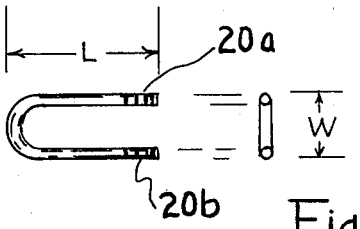
FIG. 5 is a preferred form of a pellet to be used with the catapult.
Figure 6:
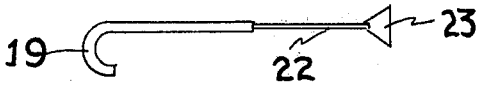
FIG. 6 is a second kind of pellet for use with the catapult.

A preferred form of the pellet is shown in FIG. 5. The length to width ratio of the pellet, L/W is at least two to one. The pellet can be formed of wire. It is grooved in the areas 20*a* and 20*b* to facilitate grasping. An alternate form of pellet is shown in FIG. 6. The hook 19 is made of wire which is of larger diameter than the tail piece 22. A fin 23 is firmly attached to the tail piece and serves both as a grasping surface and flight stabilizer.

Figure 7:
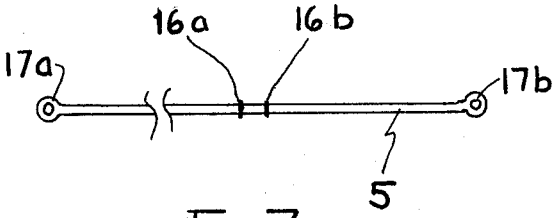
FIG. 7 is a preferred embodiment of an elastic cord for use with the catapult.

The elastic cord shown in FIG. 7 is preferably made of gum rubber, is circular in cross section and is terminated at each end by the loops 17*a* and 17*b*.

To facilitate aiming, the sight 36 shown in FIG. 1 may be employed with the catapult. The sight is comprised of a vertical rod 12 threaded at its lower end 13. Rod 12 carries the vertical slider 14 and the horizontal slider 15 to which is attached the peephole 16. Rod 12 is threaded into tapped hole 18 shown in FIGS. 1 and 4. Sliders 14 and 15 are adjustably held in place by set screws.

It will be apparent that the catapult may be modified in a number of ways. It is possible for example to use more than the double fold construction described above so as to accommodate a longer elastic cord. It is also possible to mount the reels vertically or in combinations of vertical and horizontal orientation to achieve greater degrees of guidance or compactness. These and other modifications are possible without departing from the spirit of the invention.

I claim:

1. A compact catapult for launching projectiles for target practice, plinking and the taking of small game comprised in combination of the following:

a. an elongated base having four pillars mounted to the top thereof and arranged in pairs so as to make up a front pair and a rear pair;

b. two anchoring posts also mounted to the top of said base so as to be positioned intermediate between the front and rear pairs of the pillars;

c. four conically grooved reels mounted by low friction bearings on said pillars so as to be freely rotatable;

d. an elastic cord fastened between said anchoring posts and stretched so as to pass around the reels and fit into the conical grooves, becoming partially tensed and having a center portion between the rear pair of reels which is perpendicular to the line of fire of the catapult;

e. a pair of closely spaced marks imprinted on the elastic cord in the middle of said center portion, the marks serving to define an accurately reproducible loading point for projectiles;

f. an aiming device with a horizontally and vertically adjustable peep sight mounted on one of the front pair of pillars;

g. a handle fixed to the bottom of said base permitting the catapult to be firmly held in one hand;

whereby a U-shaped projectile can be directly placed over said center portion of the elastic cord between said marks without the need for a projectile holder such as a pouch, the cord drawn back so as to tense it further and then released to cause a U-shaped projectile to be propelled along the line of fire.

2. A compact catapult as set forth in claim 1 wherein the drawing back of said elastic cord causes rotation of said reels thereby producing uniformly distributed and increased tension along the folded length of the elastic cord while at the same time retaining the cord within the conical grooves in the reels, making the user aware of any deviation from a straight drawback parallel to said base because of user-felt tension changes and thus permits user correction before release of a projectile.

3. A compact catapult as set forth in claim 1 in which release of said cord causes it first to return to its original position and then to continue accurately in a line of fire direction because the cord is forced by the conical grooving to assume a direction parallel to the base of the catapult and thus become tensed in an opposite direction so as to decelerate, said deceleration producing rapid detachment of a U-shaped projecticle as it is propelled along the line of fire.

4. A compact catapult as set forth in claim 1 in which the release of said elastic cord produces rotation of said reels thereby utilizing the entire folded length of the cord in efficiently delivering stored energy to a projectile.

5. A compact catapult as set forth in claim 1 in which the direct coupling between said elastic cord and a projectile without the use of a projectile holder fixed to the cord serves further to increase the efficiency of stored energy delivery inasmuch as the mass of a holder need not be accelerated and a part of the energy acquired during drawback then wasted during deceleration.

* * * * *